US008112027B2

(12) United States Patent
Thayer et al.

(10) Patent No.: US 8,112,027 B2
(45) Date of Patent: Feb. 7, 2012

(54) IMAGE FORMING MACHINE BLADE ENGAGEMENT APPARATUS WITH BLADE CASSETTE

(75) Inventors: Bruce E. Thayer, Spencerport, NY (US); Cheryl A. Linton, Webster, NY (US); Richard W. Seyfried, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 460 days.

(21) Appl. No.: 12/366,253

(22) Filed: Feb. 5, 2009

(65) Prior Publication Data

US 2010/0196068 A1 Aug. 5, 2010

(51) Int. Cl.
*G03G 21/00* (2006.01)

(52) U.S. Cl. ..... 399/351; 399/345; 399/350

(58) Field of Classification Search ..... 399/351
See application file for complete search history.

(56) References Cited

U.S. PATENT DOCUMENTS 5,081,505 A * 1/1992 Ziegelmuller et al. ..... 399/349
5,208,639 A 5/1993 Thayer et al.
5,264,904 A * 11/1993 Audi et al. ..... 399/71
5,385,096 A * 1/1995 Suzuki ..... 101/425
6,311,038 B1 * 10/2001 Schlueter et al. ..... 399/350
7,248,813 B2 * 7/2007 Burton ..... 399/109
2009/0110416 A1 * 4/2009 Thayer et al. ..... 399/34
2009/0190975 A1 * 7/2009 Thayer et al. ..... 399/350

* cited by examiner

*Primary Examiner* — David Gray
*Assistant Examiner* — David Bolduc
(74) *Attorney, Agent, or Firm* — Fay Sharpe LLP

(57) ABSTRACT

A blade engagement system for cleaning and/or metering a release agent onto an image forming machine moving surface, such as a photoreceptor. The blade engagement system includes a blade cassette having a plurality of blades, each including a compliant blade member having a blade tip. The blade engagement system also including a blade engagement apparatus removably receiving the blade cassette. The blade engagement apparatus having a blade positioning mechanism moving the blades, one at a time, from the blade cassette to a working position wherein the blade tip engages the moving surface for cleaning and/or metering. Used blades can be moved back into the cassette for storage. The blade cassette can be replaced with a new one after all of the blades have been used.

19 Claims, 18 Drawing Sheets

IMAGE FORMING MACHINE BLADE ENGAGEMENT APPARATUS WITH BLADE CASSETTE

BACKGROUND

Disclosed in embodiments herein are apparatuses for cleaning and/or applying release agent to an image forming machine moving surface, such as a photoreceptor, transfer surface, etc., and more specifically a blade engagement apparatus having a blade cassette holding a plurality of blades for individual withdrawal and placement into a working position in engagement with the moving surface for cleaning and/or metering.

In electrophotographic applications such as xerography, a charge retentive moving photoreceptor belt, plate, or drum is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to provide an electrostatic latent image to the photoreceptor. In a light lens copier, the photoreceptor may be exposed to a pattern of light or obtained from the original image to be reproduced. In each case, the resulting pattern of charged and discharged areas on the moving photoreceptor surface form an electrostatic charge pattern (an electrostatic latent image) conforming to the original image.

The electrostatic image on the moving photoreceptor may be developed by contacting it with a finely divided electrostatically attractable toner. The toner is held in position on the photoreceptor image areas by the electrostatic charge on the surface. Thus, a toner image is produced in conformity with a light image of the original. Once each toner image is transferred to a substrate, the image is affixed thereto forming a permanent record of the image to be reproduced. In the case of multicolor copiers and printers, the complexity of the image transfer process is compounded, as four or more colors of toner may be transferred to each substrate sheet. Once the single or multicolored toner is applied to the substrate, it is permanently affixed to the substrate sheet by fusing, so as to create the single or multicolor copy or print.

Following the photoreceptor to substrate toner transfer process, it is necessary to at least periodically clean the charge retentive surface of the moving photoreceptor surface. In order to obtain the highest quality copy or print image, it is generally desirable to clean the photoreceptor each time toner is transferred to the substrate. In addition to removing excess or residual toner, other particles such as paper fibers, toner additives and other impurities (hereinafter collectively referred to as "residue") that may remain on the charged moving surface of the photoreceptor must be removed.

Solid ink jet image forming machines generally use an electronic form of an image to distribute ink melted from a solid ink stick or pellet in a manner that reproduces the electronic image. In some solid ink jet imaging systems, the electronic image may be used to control the ejection of ink directly onto a media sheet. In other solid ink jet imaging systems, the electronic image is used to eject ink onto an intermediate imaging member. A media sheet is then brought into contact with the intermediate imaging member in a nip formed between the intermediate member and a transfer roller. The heat and pressure in the nip helps transfer the ink image from the intermediate imaging member to the media sheet.

One issue arising from the transfer of an ink image from an intermediate imaging member to a media sheet is the transfer of some ink to other machine components. For example, ink may be transferred from the intermediate imaging member to a transfer roller when a media sheet is not correctly registered with the image being transferred to the media sheet. The pressure and heat in the nip may cause a portion of the ink to adhere to the transfer roller, at least temporarily. The ink on the transfer roller may eventually adhere to the back side of a subsequent media sheet. If duplex printing operations are being performed, the quality of the image on the back side is degraded by the ink that is an artifact from a previous processed image.

To address these problems, various release agent applicators have been designed, often as part of an image drum maintenance system. These release agent applicators provide a coating of a release agent, such as silicone oil, onto the intermediate imaging member moving surface to reduce the undesired build-up of ink. It is desired to control the amount of release agent applied, since using of too much release agent causes undesirable streaks, also known as oil streaks, on the output prints.

The present application provides a new and improved apparatus for cleaning and/or metering a release agent onto an image forming device moving surface which overcomes these above-described problems.

BRIEF DESCRIPTION

A blade engagement system for cleaning and/or metering a release agent onto an image forming machine moving surface is provided.

In one exemplary embodiment, the blade engagement system includes a blade cassette including a plurality of blades, and a blade engagement apparatus having a cassette chamber adapted for removably receiving the blade cassette and a blade positioning mechanism moving the blades, one at a time, from the blade cassette to a working position in engagement with the image forming machine moving surface.

DETAILED DESCRIPTION

Figure 1:
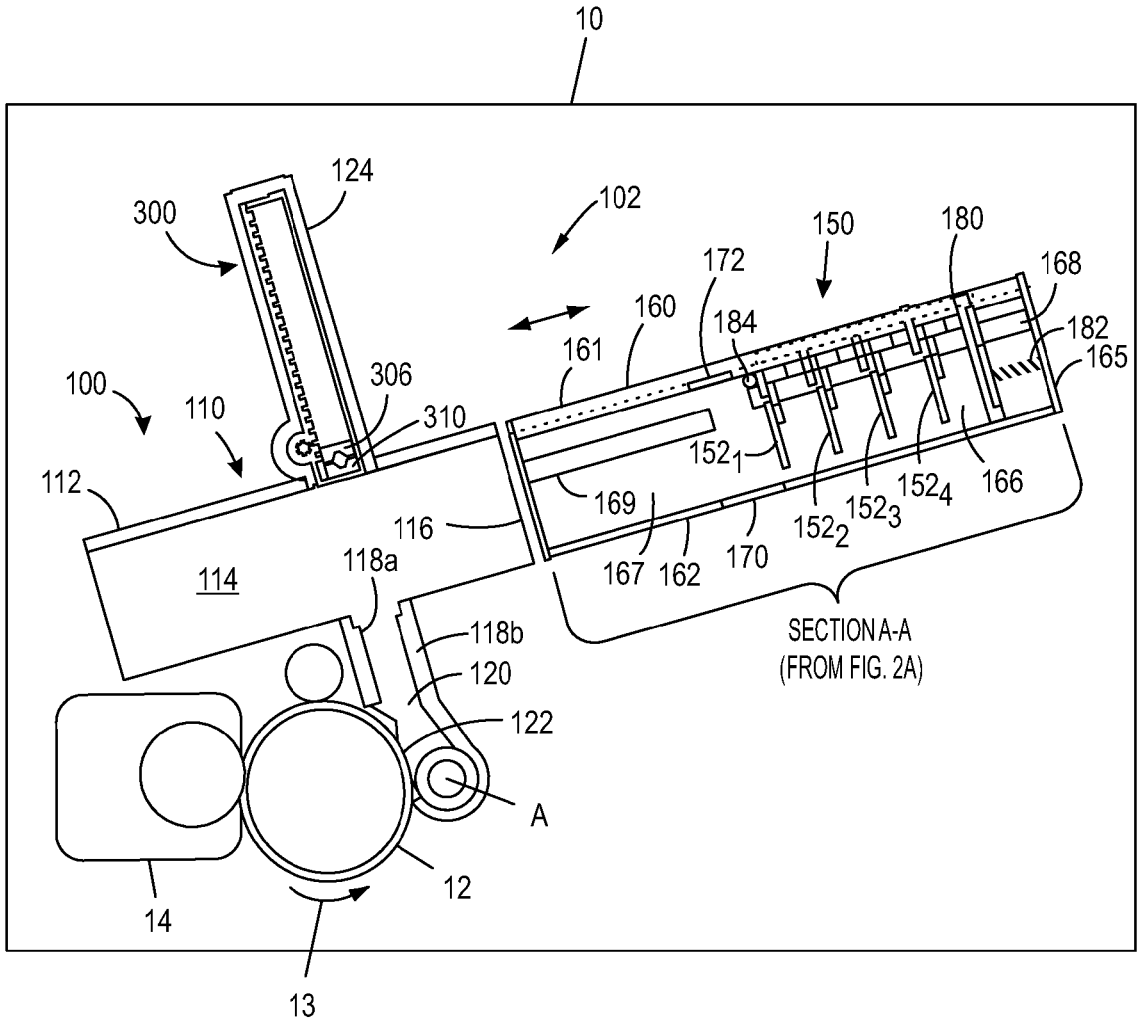
FIG. 1 is partial sectional side view of a blade cassette of section A-A in FIG. 2A being inserted into a blade engagement apparatus.

Referring now to FIG. 1, an image forming machine such as a xerographic copier, printer, multifunction machine, and the like, shown generally at 10, includes a moving surface 12 moving in an operational direction 13. The moving surface 12 can be suitable for receiving a controlled application of a release agent, or a surface suitable for cleaning, such as the removal of toner waste material etc., or both. The moving surface 12 can be a cylindrical surface such as a solid ink jet (SIJ) drum used in SIJ machines 10. In other examples, the cylindrical surface 12 can be an imaging member, such as a photoreceptor, or a glossing drum, or a transfer surface, or other like surfaces.

The image forming machine 10 includes a blade engagement system 102 including blade engagement apparatus 100 adapted to receive a removable blade cassette 150 containing a plurality of blades $\mathbf{152}_1$-$\mathbf{152}_n$ used for cleaning and/or applying a release agent to the image forming machine moving surface 12.

Figure 5:
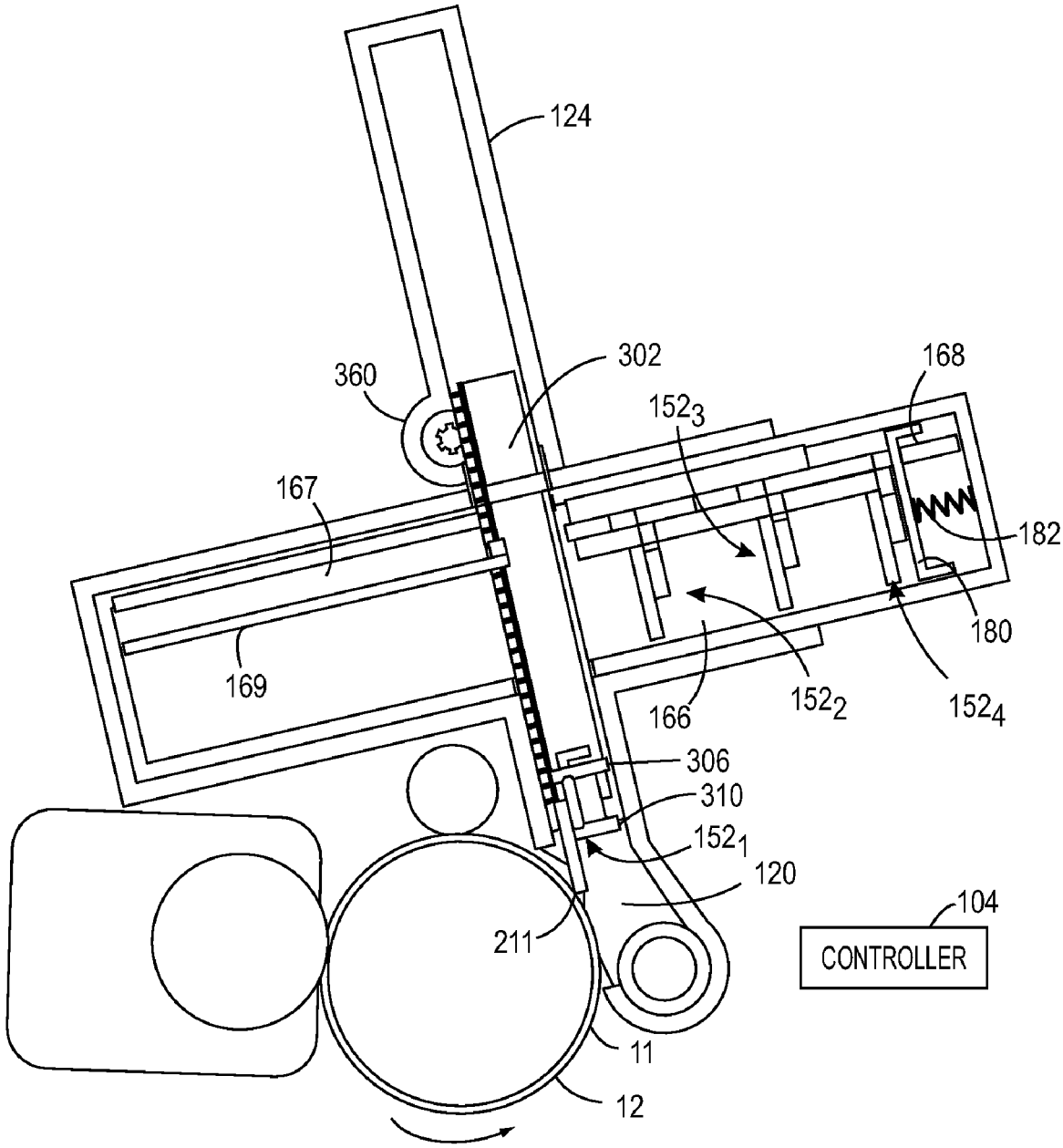
FIG. 5 is a side sectional view of the blade engagement apparatus showing a first blade moved into the working position.

For the purposes of example, the blade cassette 150 is shown to contain four blades $\mathbf{152}_1$-$\mathbf{152}_4$, however it should be appreciated that the cassette can house more than four blades. The blade engagement apparatus 100 includes a blade positioning mechanism 110 for moving one of the blades $\mathbf{152}_1$-$\mathbf{152}_4$ from the cassette into a working position, also referred to as an operational position, in controlled engagement with surface 12, as shown in FIG. 5 and described in further detail below. The blade engagement apparatus 100 (and system 102) can be controlled by a controller 104.

The blade engagement apparatus 100 (and system 102) can be a release agent application apparatus (and system) for applying a controlled amount (i.e. thickness) of release agent 11 onto the surface 12, in a process referred to herein as metering. During metering, the release agent 11 is initially applied to the surface 12 using a roller 14, or in other known manners, and then metered to a desired thickness by a blade disposed in a working position. The blade engagement apparatus 100 (and system 102) can be a cleaning apparatus (and system) for cleaning debris from the moving surface 12 with the blade disposed in the working position. The blade engagement apparatus 100 (and system 102) can be configured for cleaning, or metering, or both simultaneously.

After a blade has reached the end of its operational life, the blade positioning mechanism 110 moves the used blade from the working position into the blade cassette 150 for storage and moves another, unused blade into the working position in a manner described below. This process can be repeated until all the blades have been used, at which time the blade cassette 150 can be removed from the blade engagement mechanism 100 and a new one inserted in its place.

Figure 2A:
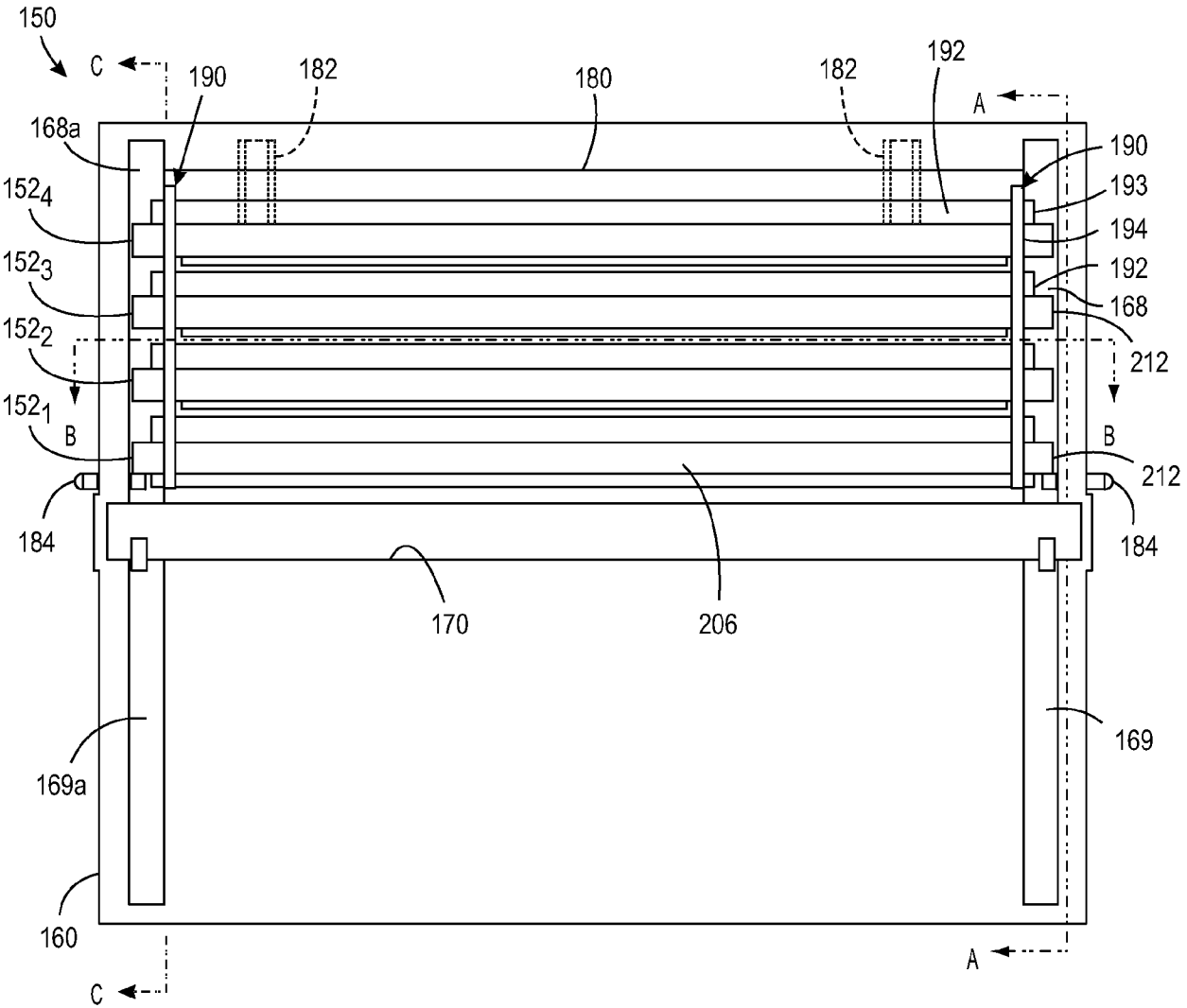
FIG. 2A is a top view of a new blade cassette with its top removed for clarity having four blades stored in a new blade storage area.
Figure 2B:
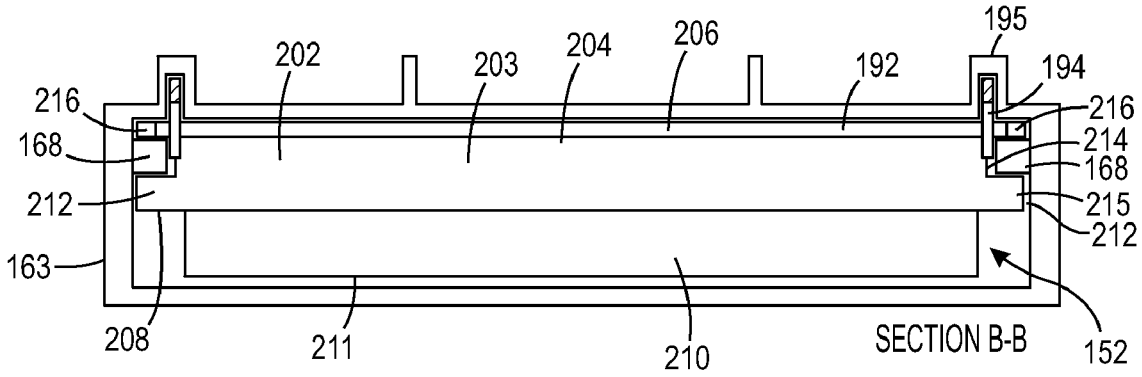
FIG. 2B is sectional view along B-B of the cassette shown in FIG. 2A.

Referring now to FIGS. 1, 2A and 2B, the blade engagement apparatus 100 includes a housing 112 having a cassette chamber 114. The housing 112 includes an opening communicating with the chamber 114 forming a cassette receptacle 116.

The blade engagement apparatus 100 also includes a pair of spaced apart walls 118*a* & 118*b* forming a chute 120 communicating with the chamber 114 and extending downwards therefrom. The chute 120 includes an opening forming a blade window 122 disposed adjacent to the surface 12. The blade window 122 extends laterally across the width of the surface 12 to be engaged by the blade while in the operational position as described in further detail below.

A blade cassette 150 having a plurality of blades $\mathbf{152}_1$-$\mathbf{152}_n$ is slid through the blade receptacle 116 and into the cassette chamber 114. The cassette 150 has a cassette housing 160 having a top 161, a bottom 162 sides 163, a first end 164, and a second end 16 disposed opposite the first end. The cassette includes a first internal portion 166, referred to as the unused blade storage section of the cassette, for storing unused blades, as shown in FIG. 1, and a second internal portion 167, referred to as the used blade storage section of the cassette, for storing used blades.

The cassette 150 includes a first pair of protrusions, each extending from the interior of the side walls 163 forming a pair of first rails 168 extending along the side walls for the length of the unused blade storage section 166 from the second end 165 to a mid portion of the cassette. The first rails 168 include flat upper surfaces 168*a* which are laterally aligned forming surfaces for supporting unused blades stored in the unused blade section of the cassette as described below.

The cassette 150 also includes a second pair of protrusions, each extending from the interior of the side walls 163 forming a pair of second rails 169 extending along the side walls for the length of the used blade storage section 167 from the first end 164 to a mid portion of the cassette. The second rails 169 include flat upper surfaces 169*a* which are laterally aligned forming surfaces for supporting used blades stored in the used blade section of the cassette as described below.

The cassette 150 also includes a laterally extending aperture 170 disposed in a mid portion of the cassette bottom 162 between the new blade storage section 166 and the used blade storage section 167, referred to as the loading/unloading aperture. The blades 152 are ejected from the cassette 150 through the loading/unloading aperture 170 and moved into the working position for use. One blade can occupy the working position at a time. At the end of a blade's operational life, it is placed back into the cassette through the loading/unloading aperture 170 and stored in the used blade section 167 while the next blade is moved from the cassette and placed into operation in the working position.

It should be appreciated that the blades $\mathbf{152}_1$-$\mathbf{152}_n$ are similar and shall be referred to generally as blade 152. As shown in FIG. 2B, each blade 152 includes a blade holder 202 formed of a rigid material such as for example, aluminum, steel, a composite, or other suitably rigid material. The blade holder 202 includes an elongated body 203 having a length sufficient for extending transversely across surface 12, with respect to the operational direction 13, when the blade 152 is placed in the working position. The blade holder body 203 includes a top 204 having a flange 206 extending at an approximate 90 degree angle from the body along the length of the blade holder for added rigidity. The blade holder body 203 also includes a bottom 208.

The rigid blade holder 202 is connected to, or integrated with, a compliant blade member 210 to evenly distribute the application forces applied to the blade 152 by the blade positioning mechanism 110. The blade member 210 extends from the bottom 208 of the blade holder 202 and includes a blade tip or edge 211 extending along most of the length of the holder. The blade member 210 is formed of a compliant material, such as polyurethane, which bends, or deflects, as the blade 152 is moved into the working position in which the blade tip 211 is pressed against, or towards, surface 12 generating a blade load at the tip against the surface, or material on the surface such as a release agent being metered. The tip 211 can be coated with PMMA, SureLube, toner or other initial blade lubricant to prevent blade flip as the blade 152 is moved into the working position, if so desired.

The blade holder body 203 also includes oppositely disposed lateral ends 212. A recess 214 is formed in the body 203 at each end 212 beneath the flange 206 defining a tang 215 extending from each end of the body below the recess. The blade member 210 extends along the blade holder bottom between the tangs 215. The ends of the flange 206 extending laterally outwards over the recess 214 form laterally extending tabs 216. In the unused blade storage section 166 of the cassette 150, the rails 168 extend into the recesses 214 supporting unused blades 152 in a sequential line of individual/unattached blades, each blade oriented in a similar manner with its tabs supported on the upper rail surfaces 168*a*. In the used blade storage section 167, rails 169 extend into the recesses 214 of the used blades 152 supporting the used blades for sliding movement as blades are moved back into the cassette through the loading/unloading aperture 170 for storage.

The cassette 150 includes a blade conveyor assembly 190, shown in FIGS. 2A and 2B, for moving the blades 152 sequentially from the new blade storage section 166 to the loading/unloading aperture 170 for use, and then to the used blade storage section 167 for storage after use. In the first exemplary embodiment, shown in FIGS. 1-9D, the blade conveyor assembly 190 is spring biased by spring 182.

The blade conveyor assembly 190 includes a plurality of laterally extending conveyer bars 192 having ends 193 supported on the rails 168, 169. The blade conveyor assembly 190 also includes a pair of spaced apart link members 194 extending at right angles to the bars 192 connecting the bars together in a spaced apart manner such that one bar is disposed between each blade 152. A different bar 192 abuts the blade holder flange 206 behind each blade $152_1$-$152_n$ for moving that blade in a direction towards the loading/unloading aperture 170.

The connector members 194 can extend into parallel recessed channels 195 formed in the interior of the top 161 of the cassette housing 160 which enable the blade conveyor assembly 190 to track straight and stay square as it moves the blades towards the loading/unloading aperture for use. The connector members 194 can also extend down, between each blade 152, so that each rests against an inner side of the rails 168 enabling the blade conveyor assembly to track straight and stay square, keeping the blades parallel, and preventing them from skewing and binding as they slide along the rails 168.

The blade conveyor assembly 190 also includes an end plug 180 extending behind the sequentially last blade $152_n$ which is spring biased towards the loading/unloading aperture 170 by a compression spring 182. The spring biased blade conveyor assembly 190 urges the blades 152 towards the loading/unloading aperture 170 as their tabs slide over the rail upper surfaces 168*a*. A pin 184 extending through each cassette side wall 163 is used to prevent the unused blades from reaching the aperture 170 while the cassette is not in place in the cassette chamber 114.

Referring now to FIGS. 1, 3A-3D and 5, the blade positioning mechanism 110 includes a pair of arm assemblies 300, one disposed at each lateral side of the blade engagement apparatus 100. The arm assemblies 300 are located in housings 124 extending from the top of the blade engagement housing 112 directly above the chute 120 for moving a blade 152 from the blade cassette 150 into an operational position in engagement with the surface 12 and subsequently returning it to the cassette as shall be described in further detail below.

The arm assemblies 300 are similar and therefore, one shall be described in detail. The arm assembly 300 includes an arm 302 having a rack 303 disposed on a first side for cooperating with a sprocket 362 turned by a powered actuator, such as motor 360 shown in FIGS. 5 and 8, for moving the arm 302 up and down. The motor 360 can be a stepper motor, or other motor, controlled for bidirectional actuation by a controller 104. The controller 104 can be in the image forming machine 10, or in the blade engagement apparatus 100, and electrically connected to the motor 360 for controlling its actuation A second arm 304 is coupled to the first arm 302 for sliding, up and down movement relative to the first arm, and also for mutual up and down movement together with the first arm via actuating movement by motor 360 as described in further detail below. In another exemplary embodiment, the arms 302 and 304 can be moved up and down with a screw 352 turned by an actuator such as a motor cooperating with a threaded member 350 on the first arm, shown with dotted lines to indicate an alternate embodiment.

Figure 3A:
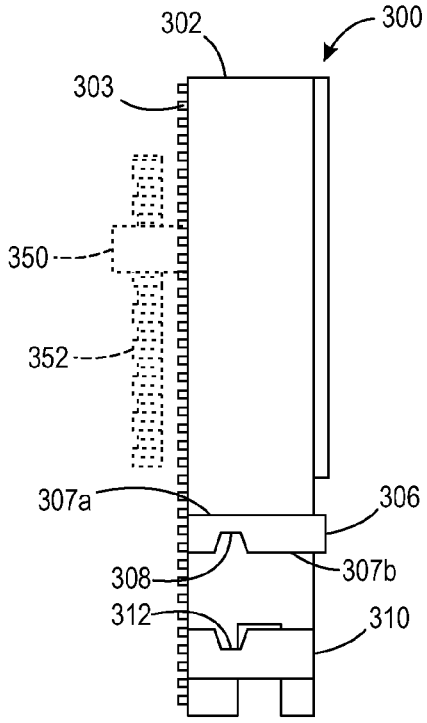
FIG. 3A is a front view of an arm assembly.
Figure 3B:
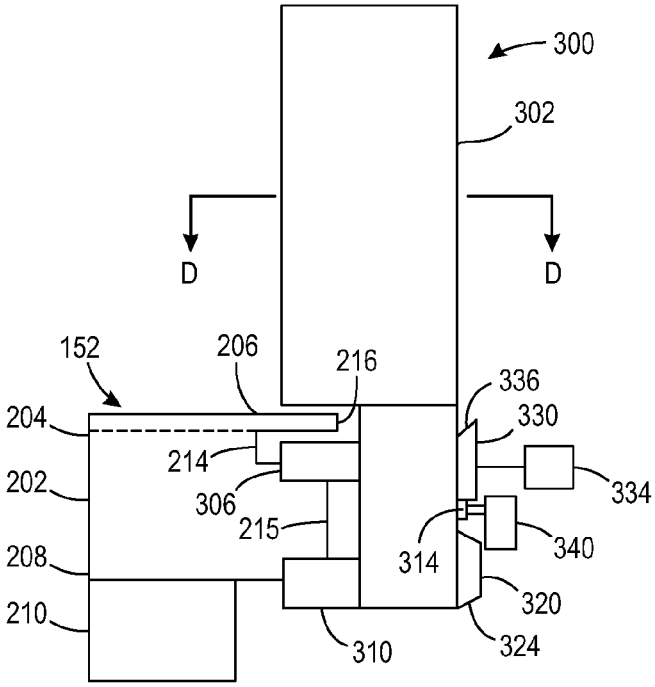
FIG. 3B is a side view of an arm assembly gripping a partially shown blade.
Figure 3C:
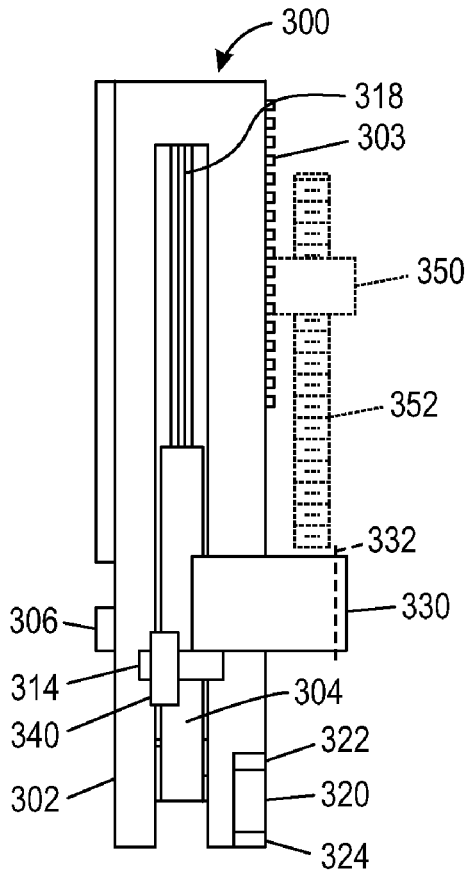
FIG. 3C is a back view of an arm assembly.
Figure 3D:
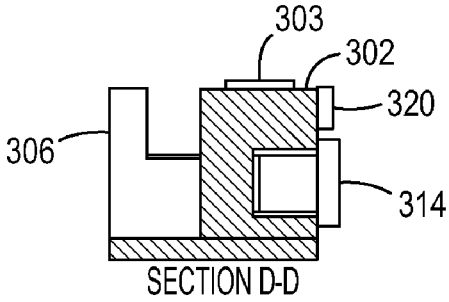
FIG. 3D is a sectional view of the arm assembly without a blade along D-D of FIG. 3B.

The first arm 302 includes an upper clamp jaw 306 having an upper surface 307*a* and a lower surface 307*b*. The upper clamp jaw 306 can also include downwards facing recess 308 in the lower surface 307*b*. The second arm 304 includes a lower clamp jaw 310 which can include an upwards facing recess 312 aligned with recess 308. The upper and lower clamp jaws 306 and 310 are arranged in a facing relationship with each other. The second arm 304 is spring biased upwards with respect to the first arm 302 by spring 318 to bias the lower clamp jaw 310 in a direction towards the upper clamp jaw 306 to clamp the blade end 212 between the jaws. The clamp jaws 306, 310 of one arm assembly 300 are arranged in a facing relationship with the jaws the other arm assembly for gripping both ends 212 of the blade holder. In one exemplary embodiment, the jaws 306, 310 can clamp the blade tangs 215 in recesses 308 and 312, as shown in FIG. 3B.

The second arm 304 includes a projection 314 extending from a side of the arm assembly 300 opposite jaw 310. A stop 330 disposed in the blade engagement apparatus 100 is used to abut the projection 314 preventing movement of the second arm 304, and its lower jaw 310, while the first arm 302 is moved by motor 360 to move the upper jaw relative to the lower jaw for clamping and unclamping the blades 152, as described in further detail below. The stop 330 can be moved away from the projection 314, along a pivot axis 332 or by translating it laterally, such as by using a solenoid 334 connected to the stop. Moving the stop 330 away from projection 314 a sufficient distance to avoid this abutment enables the jaws 306 and 310 to be moved together such as when the arms are withdrawn into the arm housings 124. Alternatively, the first arm can include a projection 320 extending from a side opposite the upper jaw 306 having an upper beveled edge 322 and a lower beveled edge 324 which moves the stop away from the second arm projection 314 on its pivot axis 322 as the first arm is moved.

Referring now to FIGS. 1, 4A, 4B and 5, the operation of the blade engagement apparatus 100 shall be described. To place a blade cassette 150 into the blade engagement apparatus 100, the arm assemblies are withdrawn, or retracted, upwards and into the housings 124 such that the jaws are moved up and out of the cassette chamber 114. The new blade cassette 150 is pushed into the blade receptacle 116 so that the cassette is received into the chamber 114 and the loading/unloading aperture 170 is aligned with the chute 120. The new cassette 150 includes a plurality of new, unused blades disposed in the unused blade section 166 and biased towards the loading/unloading aperture 170 by the guide assembly 190 as described above.

After the cassette 150 is in place in the chamber 114, the arm assemblies 300 are lowered with motor 360 moving each of the first and second arms 302 and 304 downwards together. The stop 330 is moved away from the second arm projection 314 using solenoid 334, or it is pushed away by projection 320 on the first arm as it passes by, allowing the second arm projection to reach a position below and adjacent the stop 330 as shown in FIG. 3B. A sensor 340 sensing the location of the second arm projection 314 adjacent stop 330 can be used to determine that the second arm 304 and the lower jaw 310 are in position for gripping a blade 152.

Figure 4A:
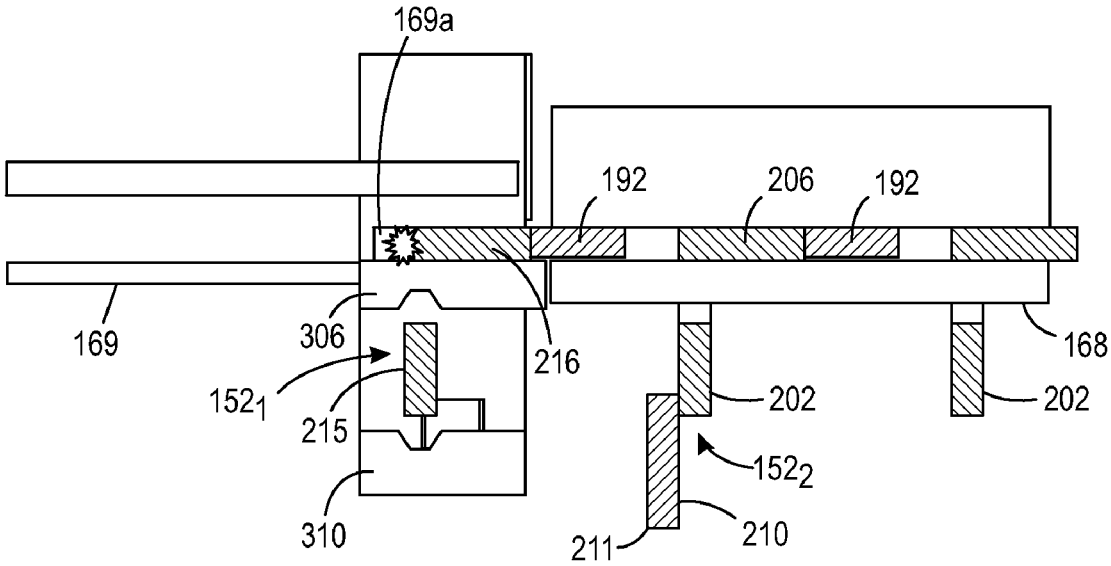
FIGS. 4A-4B illustrate a portion of a cassette and a portion of an arm assembly gripping a blade and moving it into a working position.
Figure 4B:
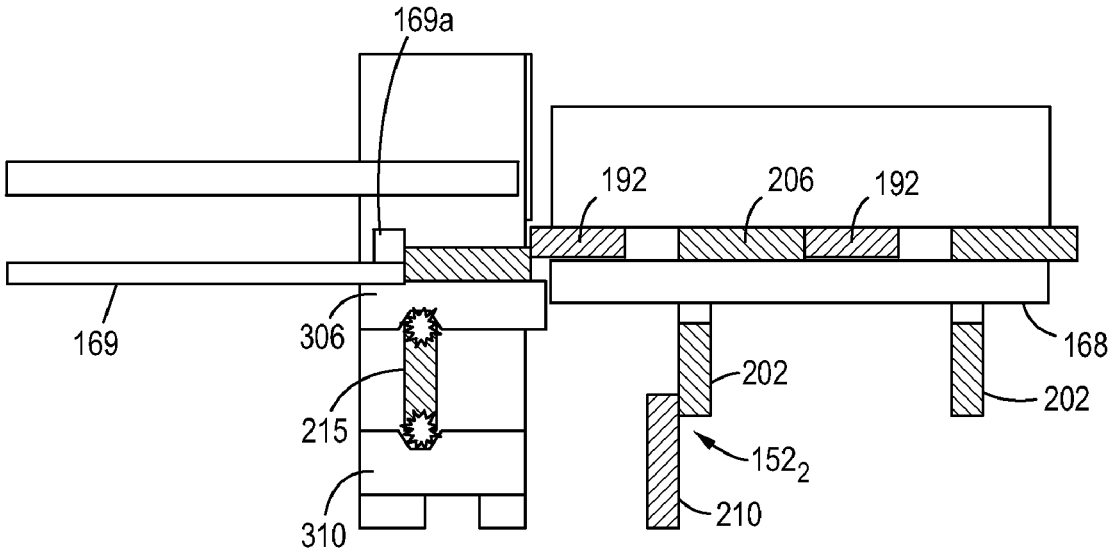

The motor 360 is then reversed, raising first arms 302 relative to second arms 304, which are prevented from being raised by stop 330, thereby opening the jaws 306 and 310 to accept the first blade $\mathbf{152}_1$, as shown in FIG. 4A. The pins 184 are retracted allowing the first blade to be moved along rails 168 by the blade conveyor assembly 190 until the blade holder tabs 216 of flange 206 abut stops 169*a* on the second rails 169 (shown by the star in FIG. 4A) and the first blade $\mathbf{152}_1$ is positioned over the loading/unloading aperture 170.

The motor 360 is reversed again lowering the first arms 302 while the second arms 304 remain stationary due to the spring bias provided by springs 318. Lowering the first arms 302 moves the upper clamp jaws 306 downwards clamping the tangs 215 in the facing recesses 308 and 312 of the respective jaws 306 and 310, as shown by the stars in FIG. 4B. It can be determined that a blade is clamped by the jaws 306, 310 by sensing the second arm projection 314 is adjacent stop 330 via sensor 340 and determining the relative positions of the jaws by monitoring the first arm position such as by monitoring the actuation of the motor 360. A higher first arm position can indicate a blade 152 is clamped by jaws 306 and 310, whereas a lower first arm position can indicate a blade is not present.

As shown in FIG. 5, the arm assemblies 300 are lowered further, and the second arms 304 travel with the first arms 302 moving the first blade $\mathbf{152}_1$ down the chute 120 until the blade reaches the working position. At the working position, the blade member 210 extends through the blade window 122 and the blade tip 211 is pressed against, or towards, surface 12 with a predetermined application force to generate a desired blade load at the blade tip 211 towards surface 12 for metering, or cleaning, or both.

Figure 6A:
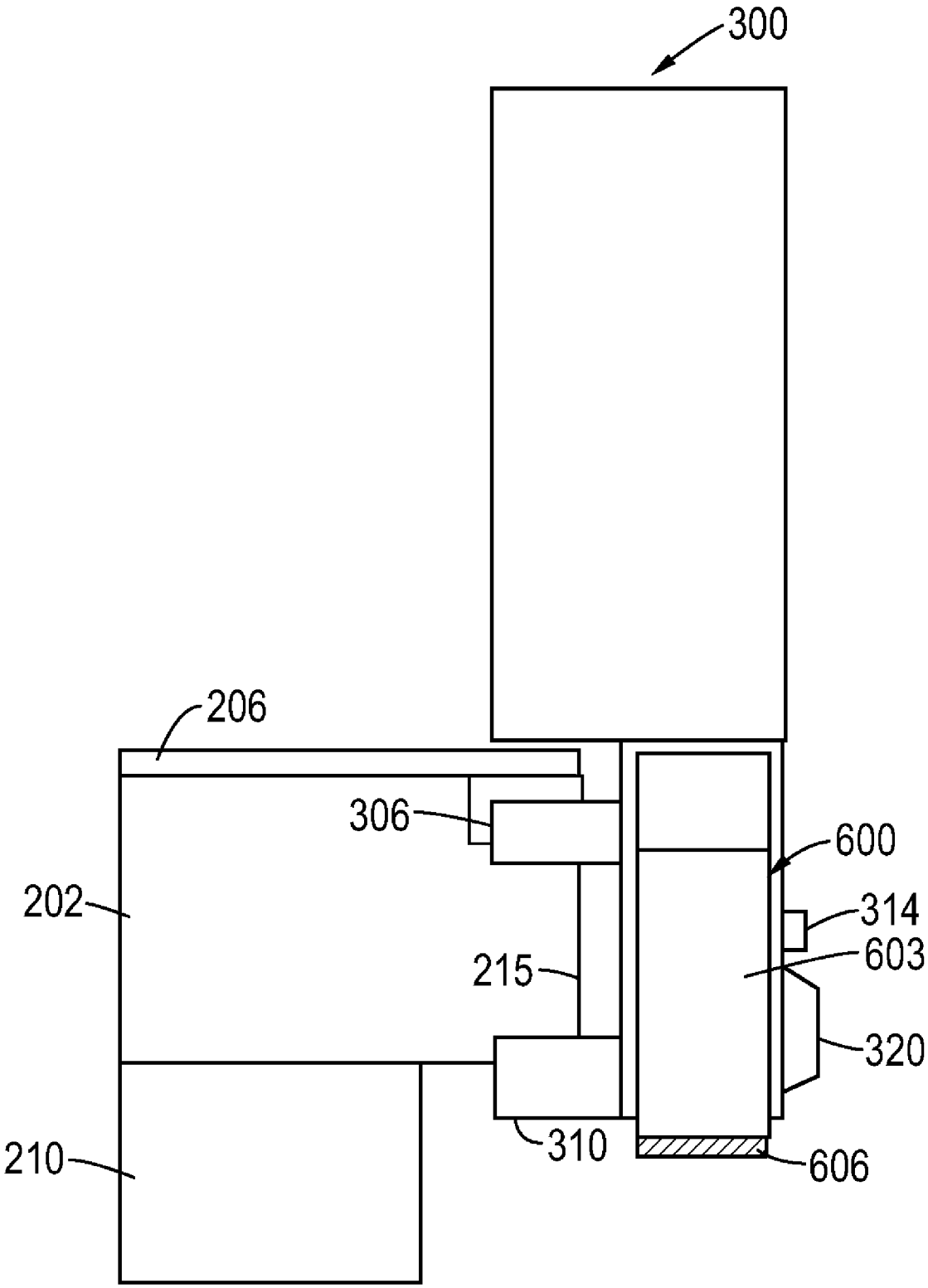
FIG. 6A is a side view of an arm assembly received in an exemplary blade guide and gripping a blade, only a portion of which is shown.
Figure 6B:
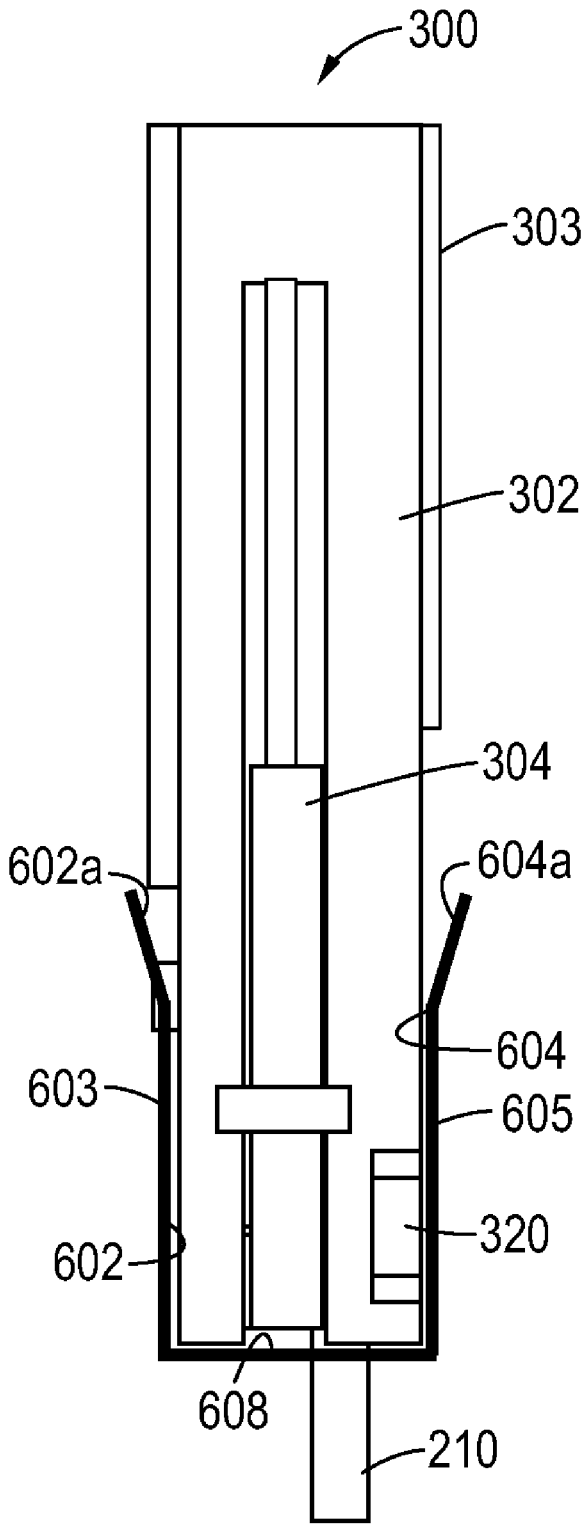
FIG. 6B is a front view of the arm assembly received in the blade guide shown in FIG. 6A.

The blade engagement apparatus 100 can include blade guides for locating a blade 152 with respect to surface 12 when placing the blade into the working position. In some exemplary embodiments, the blade guides can include one or more surfaces cooperating with the arms as they move a blade into the working position. Referring to FIGS. 6A and 6B a blade guide 600 includes a first surface 602 spaced apart from a second surface 604. The surfaces 602 and 604 can be parallel or include parallel portions. The surfaces 602 and 604 can be the surfaces of spaced apart plates 603 and 605, or portions 606 of the blade engagement apparatus 100 disposed adjacent the arm assemblies 300 for receiving the arms 302, 304 therebetween as they move the blade 152 into the working position. The surfaces 602 and 604 can stabilize the orientation of the blade 152 with respect to the surface 12 as the blade enters the working position, reducing chatter. The surfaces 602 and 604 can include flared portions, 602*a* and 604*a* respectively, providing a wider opening for receiving the arm assemblies 300.

The surfaces 602 and 604 are oriented with respect to moving surface 12 to set and maintain a consistent, predetermined blade angle for each blade 152 as it is placed into the working position. Controlling the positioning of the arms 302 and 304 controls the positioning of the jaws 306 and 308 clamping the blade holders 202 which controls the position of the blade member with respect to the surface 12.

The guide 600 can include an end surface 608 providing a stop for the arm assemblies 300 moving towards the surface 12. Moving the arm assemblies 300 against the stop produces a predetermined blade load at the blade tip 211 which can be repeated for each of the similarly shaped blades 152.

Figure 6C:
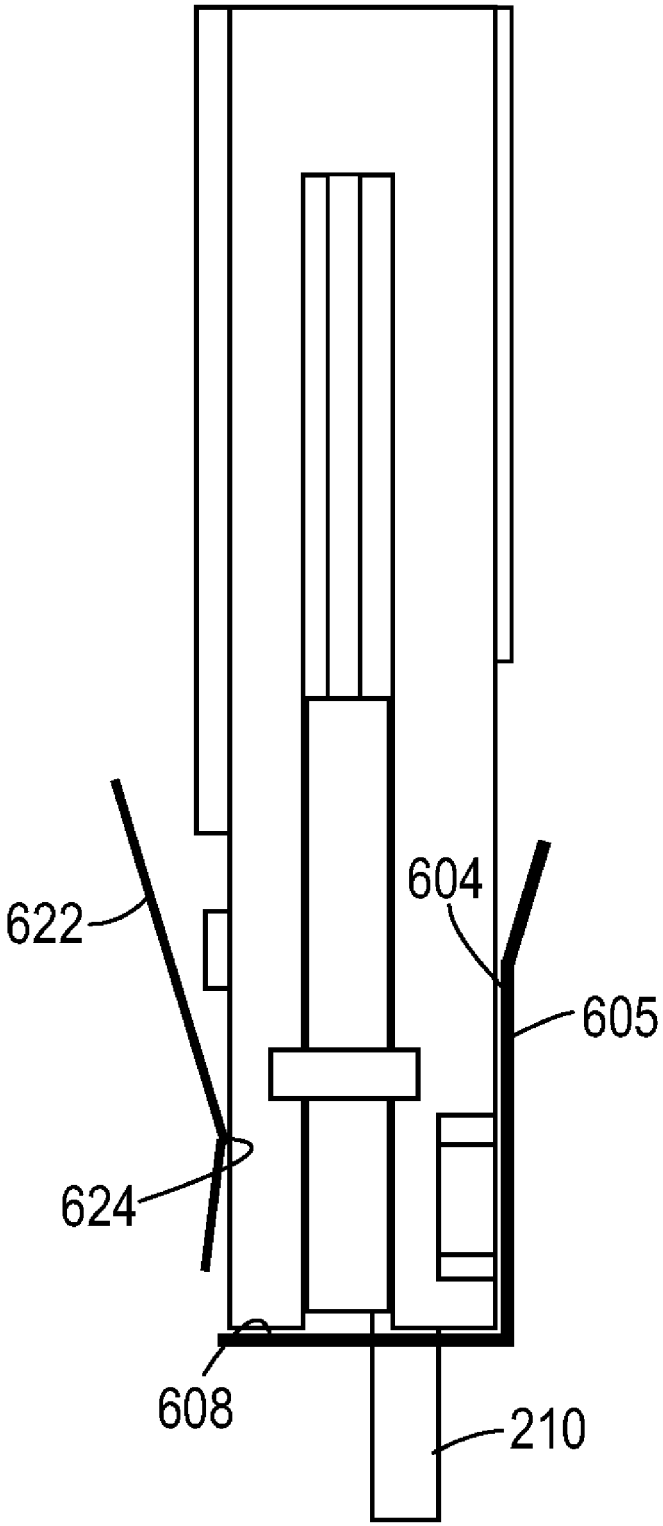
FIG. 6C is a front view of the arm assembly received in another embodiment of blade guide.

Referring to FIG. 6C, in another exemplary embodiment, the guide 620 can include a spring biased member 622 having a surface 624 biased towards surface 604 for receiving the arm assemblies 300 therebetween and pressing the arm assemblies against surface 604 providing similar control over blade positioning and blade load as the guide 600.

Figure 7A:
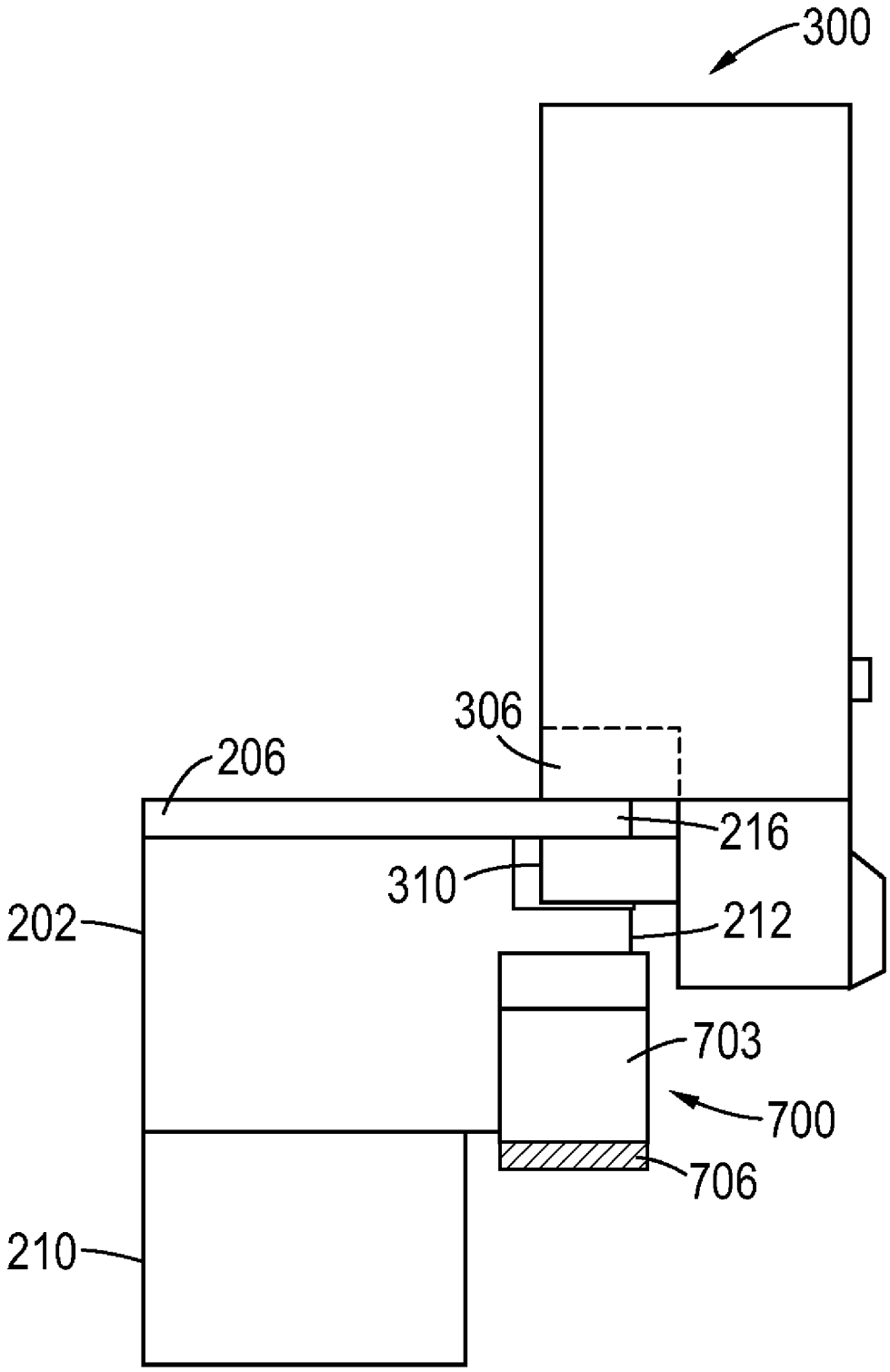
FIG. 7A is a side view of an arm assembly gripping blade, only a portion of which is shown, and the blade is received in another embodiment of a blade guide.
Figure 7B:
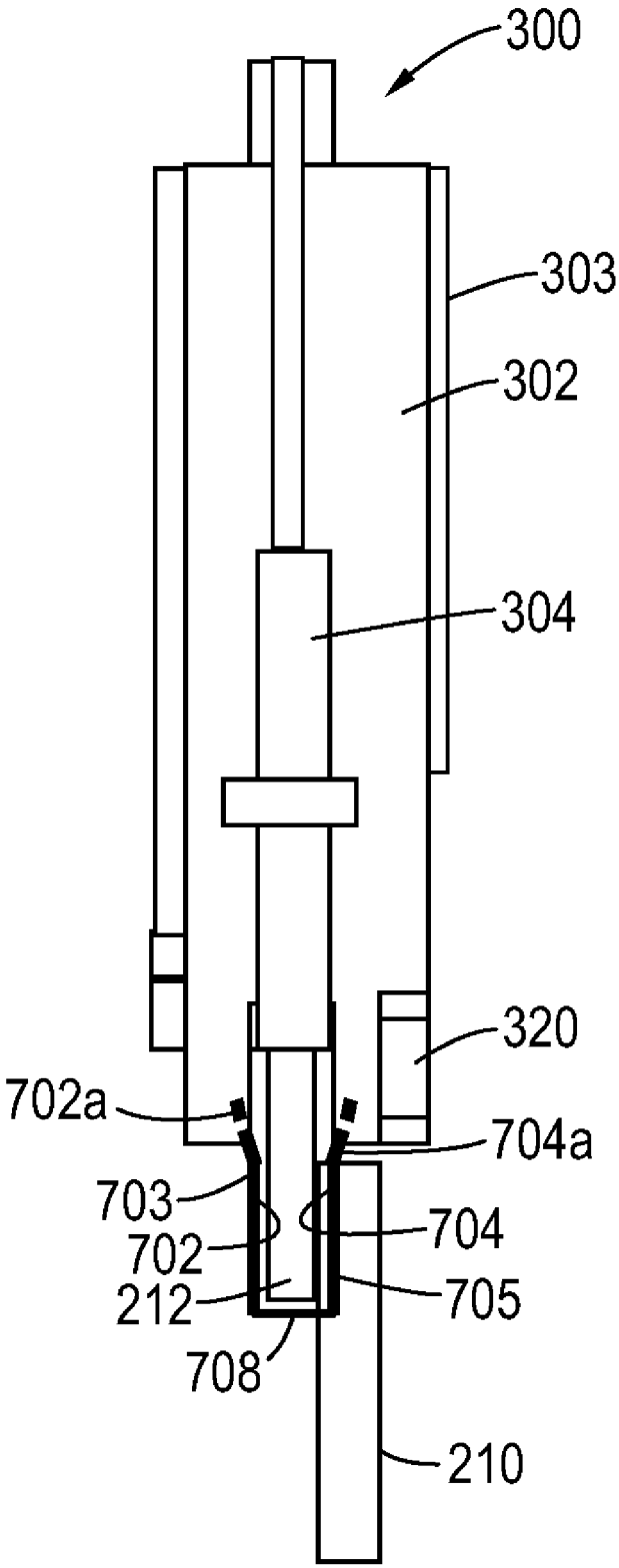
FIG. 7B is a front view of the arm assembly gripping a blade which is received in the blade guide shown in FIG. 7A.

In other exemplary embodiments, the blade guide can include one or more surfaces cooperating with the blade 152 as it is moved into the working position. Referring to FIGS. 7A and 7B, a blade guide 700 can include a first surface 702 spaced apart from a second surface 704 for receiving the blade holder end 212 therebetween providing similar control over blade positioning and blade load as the guide 600. The surfaces 702 and 704 can be the surfaces of spaced apart plates 703 and 705, or portions 706 of the blade engagement apparatus 100 disposed adjacent the arm assemblies 300 for receiving the arms 302, 304 therebetween as they move the blade 152 into the working position. The surfaces 702 and 704 can include flared portions, 702*a* and 704*a* respectively, providing a wider opening for receiving the blade holder 202 as the blade is moved into the working position.

The guide 700 can include an end surface 708 providing a stop for the blade 152 as the arm assembly 300 moves it towards the surface 12, producing a predetermined blade load for each blade as described above.

Figure 7C:
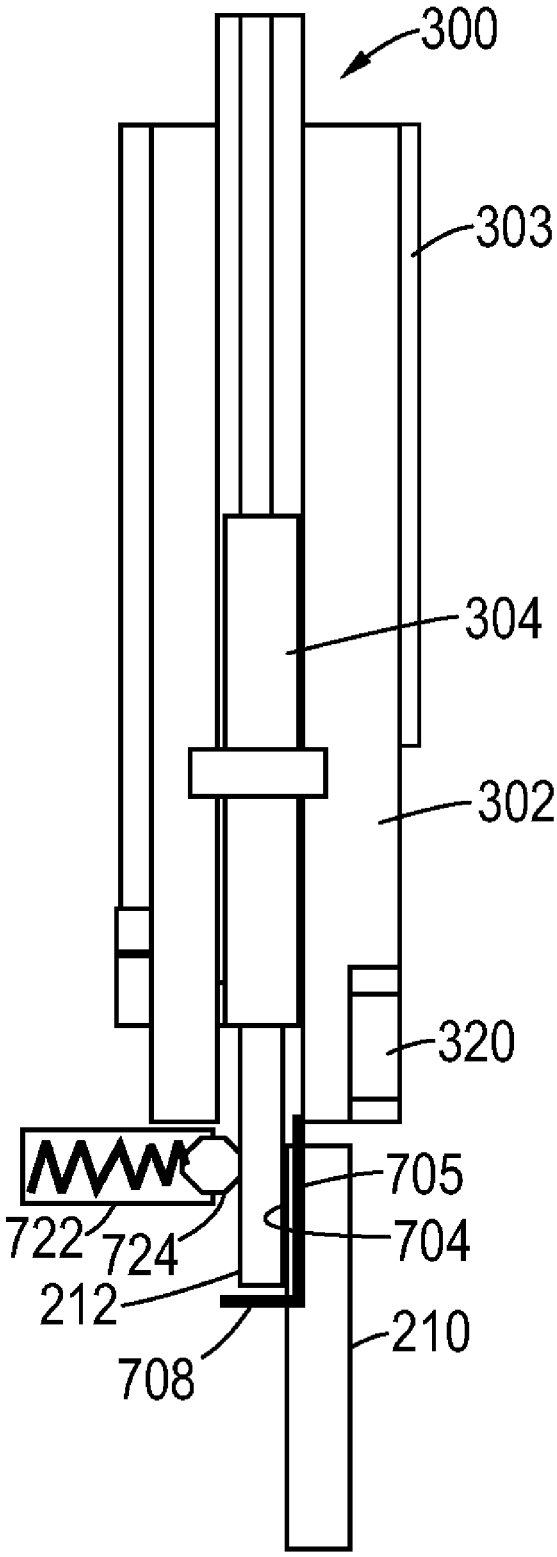
FIG. 7C is a front view of an arm assembly gripping a blade which is received in another embodiment of a blade guide.
Figure 8:
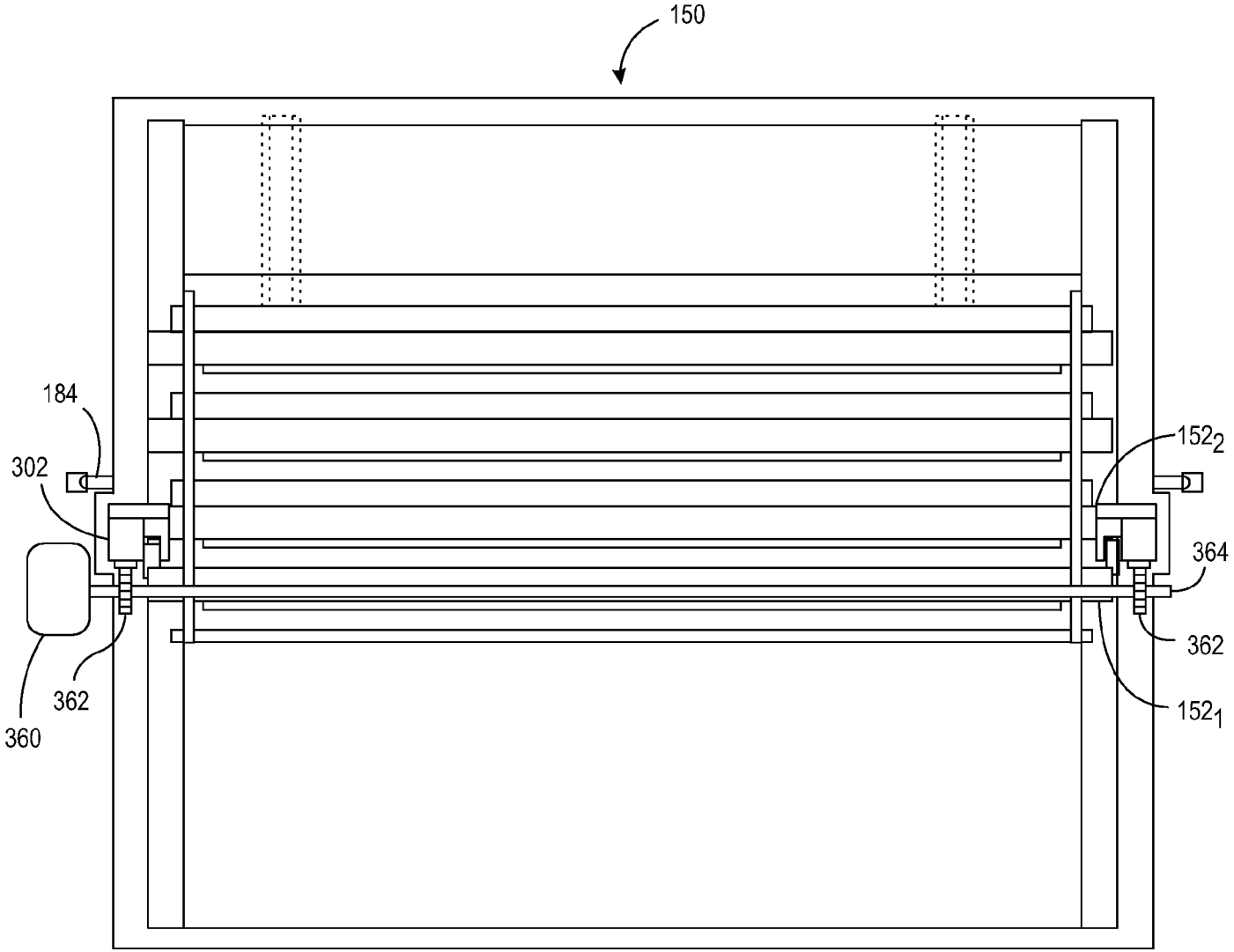
FIG. 8 is a top view of a blade cassette with top removed for clarity in a blade engagement apparatus with top removed to show the arm assemblies illustrating a spring biased blade conveyor.

Referring to FIG. 7C, in another exemplary embodiment, the guide 720 can include a spring biased member 722 having a surface 724 biased towards surface 704 for receiving the arm assemblies 300 therebetween and pressing the arm assemblies against surface 704, such as the surface of plate 705, providing similar control over blade positioning and blade load as the guide 600. The spring biased member 722 can be a ball, an arm or other structure biased towards surface 704.

The blade load can be increased while the blade 152 is in the working position by the motor 360 moving the arm assemblies downwards thereby moving the blade holder 202 in a direction towards the surface 12, increasing the deflection of the compliant blade member 210 which can also be referred to as increasing the interference of the blade 152. Increasing the blade load can meter a thinner layer of release agent 11 onto the surface during a metering operation, or clean more debris from the surface during a cleaning operation, or both. The blade load at tip 211 can be decreased while the blade 152 is in the working position, to meter a thicker layer of release agent and/or remove less debris from surface 12, by the actuator 360 moving the arm assemblies upwards thereby moving the blade holder 202 in a direction away the surface 12 while the blade tip 211 remains in contact with the surface.

Sensors can be used to monitor for streaks on output prints or on moving surface 12 and motor 360, controlled by controller 104, can provide incremental bi-directional changes in rotation to arm assemblies 300 moving the blade 152 towards or away from surface 12 to make small changes in the blade load to achieve a minimum blade load needed for preventing streaks during image forming, as described in further detail in the co-pending application U.S. application Ser. No. 12/201,140 filed Aug. 29, 2008, entitled "SYSTEM AND METHOD OF ADJUSTING BLADE LOADS FOR BLADES ENGAGING IMAGE FORMING MACHINE MOVING SURFACES", the disclosure of which is hereby incorporated by reference in its entirety.

It is contemplated that two motor actuators 360, one for each arm assembly 300, can be used and controlled separately, if so desired. Using two motor actuators 360, the blade 152 can be skewed in the chute 120, such that the blade holder 210 is not parallel with respect to the surface 12, by moving the arm assemblies 300 such that each of the associated jaws are disposed a different distance from the surface. In this manner, it is possible to vary the blade interference, and thus the blade load, differently at each end of the blade 152.

At the end of the operational life of a blade 152, the used blade is withdrawn from operation by moving it from the working position back into the blade cassette for storage in the used blade section 167. Referring to FIGS. 8, and 9A-9D, a used blade $\mathbf{152}_2$ which is the second sequential blade in the blade cassette, is shown being moved up the chute 120 and into the used blade section 167 behind the first sequential used blade $\mathbf{152}_1$.

Figure 9A:
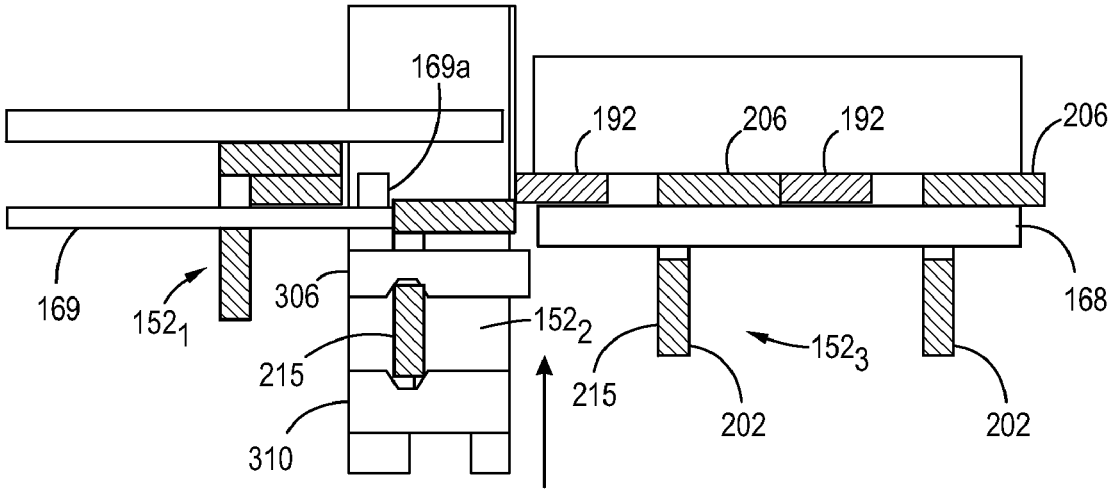
FIGS. 9A-9D illustrate a portion of a cassette and a portion of an arm assembly moving a used blade from a working position back into the cassette for storage.
Figure 9B:
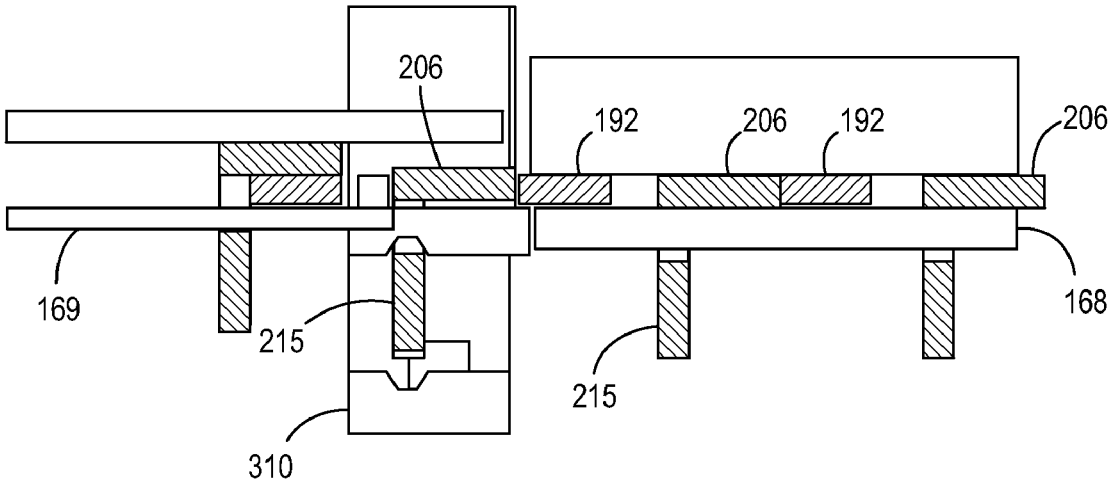
Figure 9C:
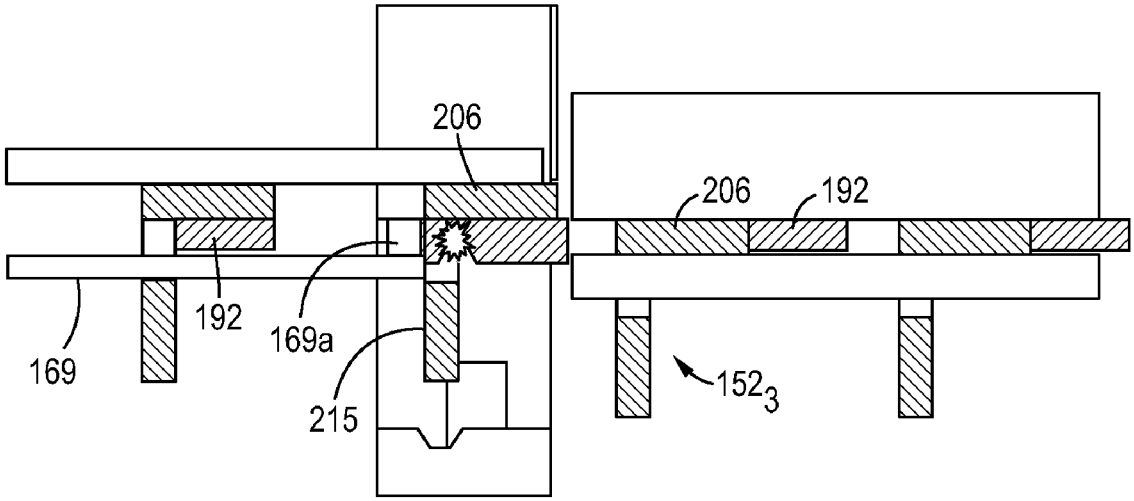
Figure 9D:
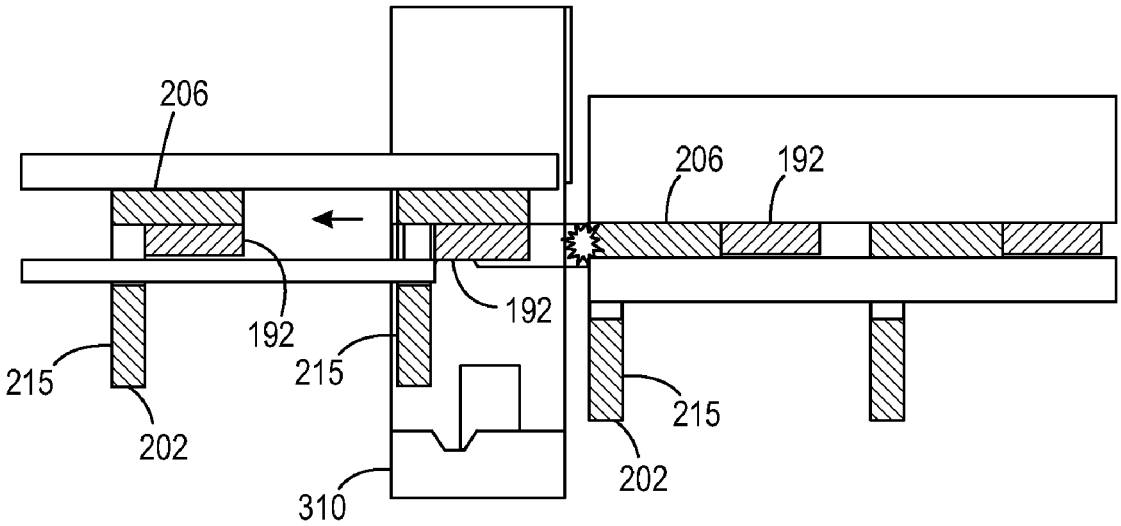

The arm assemblies 302 are moved upwards via actuator 360 as shown in FIG. 9A until the second arm projections 314 abut stops 330. The first arms 302 are raised further moving the upper jaw 306 upwards to unclamp the tangs 215 as shown in FIG. 9B. The first arm 302 is raised still further lifting the blade tabs above the stop 169*a* and above the biased conveyor bar 192 enabling the bar to move into abutment with the blade holder body 203 beneath the flange 206, as shown by the star in FIG. 9C. As the blade holder tab 216 is moved above the stops 169*a* the biased conveyer bar 192 moves along the used blade rails 169 moving the used blade into the used blade section 167 of the cassette 150. The first arm 302 is then lowered to move the upper jaw below the sequentially next unused blade which is then clamped and moved down the chute into the working position in a manner as described above.

Figure 10:
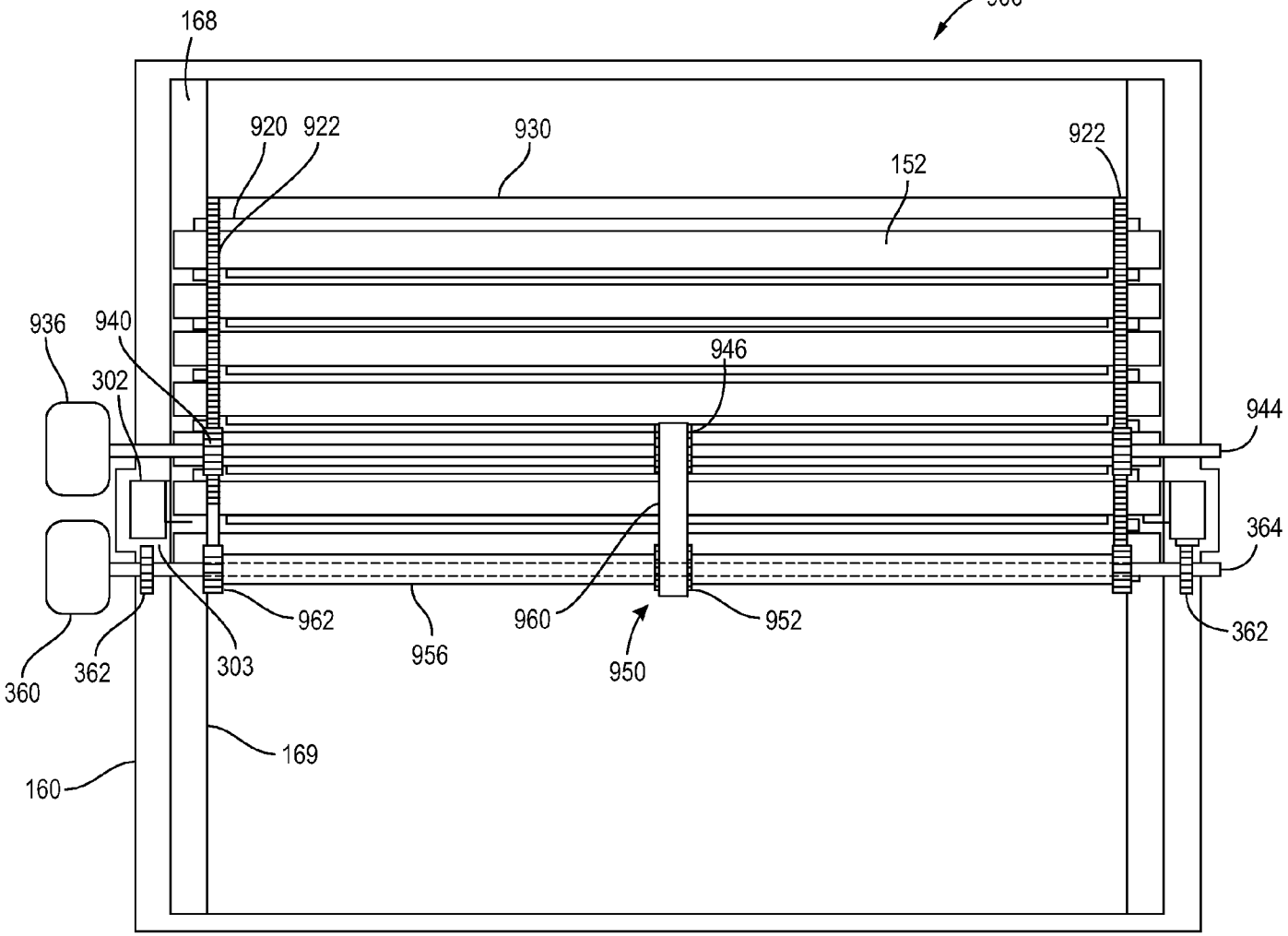
FIG. 10 is a top view of a blade cassette with top removed for clarity in a blade engagement apparatus with top removed to show the arm assemblies illustrating a power operated blade conveyor.
Figure 11:
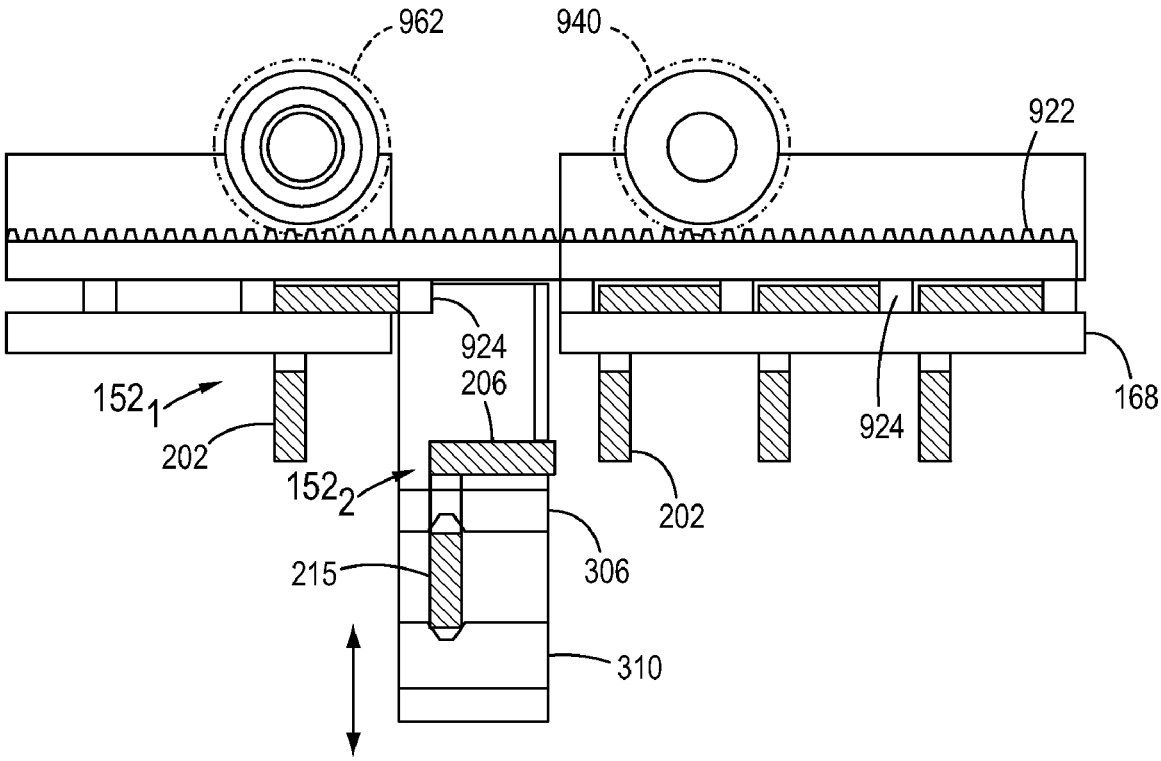
FIG. 11 is a sectional side view of a portion of the blade engagement apparatus and cassette shown in FIG. 10.

Referring now to FIGS. 10 and 11, in another exemplary embodiment, the cassette, shown generally at 900, includes a power operated blade conveyor assembly 920 moved by an actuator motor 936. The conveyor assembly 920 includes a pair of spaced apart racks 922, one disposed at each lateral side of the blade cassette on top of the blade holder flanges 206. The racks 922 extend parallel to each other and perpendicular to the direction of movement of the blades along rails 168 and 169. The conveyor assembly 920 also includes a plurality of spacer members 924 extending downwards from the racks 922 such that one spacer member is disposed behind the blade holder flange 206 of each blade 152. The racks 922 can be connected to each end of a member 930 extending parallel to the blades 152 keeping the parallel racks connected together in the spaced apart relationship.

A main shaft 944 extends from a powered actuator, such as motor 936, to a pair of spaced apart sprockets 340 disposed above the unused blade storage section, each meshed with one of the racks 922 for moving the racks in a direction towards the loading/unloading aperture 170 as the motor 936 rotates. A second pair of sprockets 962 are disposed above the used blade storage section 167 and mesh with the racks 922 for moving the used blades from the loading/unloading aperture into the used blade storage section. The second sprockets 962 are disposed on an idler tube 956 mounted on the arm shaft 364. The idler tube 956 is coupled to the main shaft 944 for mutual rotation using a belt assembly 950 including a belt 960 connecting a sprocket 946 on the main shaft to a sprocket 952 on the idler shaft. In this manner, a single motor 936 can drive both racks 922 for moving the blades 152 from the unused blade storage section to the loading/unloading window and on to the used blade storage section.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A blade engagement system for an associated image forming machine having an associated moving surface comprising:

a blade cassette including a plurality of blades; and a blade engagement apparatus having a cassette chamber adapted for removably receiving the blade cassette and a blade positioning mechanism ejecting a blade from the blade cassette and moving the blade to a working position in engagement with the associated image forming machine moving surface.

2. The blade engagement system of claim 1 further comprising the blade cassette having a used blade storage section for storing a plurality of used blades, the blade positioning mechanism moving the blade from the working position back into the blade cassette after use for storage in the used blade storage section.

3. The blade engagement system of claim 2 wherein the blade positioning mechanism includes an arm assembly disposed adjacent the blade cassette received in the cassette chamber and an actuator moving the arm assembly for moving the blade from the blade cassette to the working position for use and back into the blade cassette after use for storage in the used blade storage section.

4. The blade engagement system of claim 3 wherein the arm assembly includes a first arm having a jaw, and a second arm connected to the first arm for movement therewith having a jaw disposed in a facing relationship with the first arm jaw for holding a blade between the jaws, the first arm being moveable with respect to the second arm for opening and closing the jaws.

5. The blade engagement system of claim 4 wherein the actuator is connected to the first arm for moving the first arm, the blade engagement apparatus further comprising a stop for abutting the second arm preventing movement of the second arm as the first arm is moved by the actuator for opening and closing the jaws.

6. The blade engagement system of claim 5 wherein the blade positioning mechanism includes a pair of arm assemblies each disposed in the blade engagement apparatus at an opposite side of the blade cassette chamber for holding the lateral ends of the blade for movement into the working position.

7. The blade engagement system of claim 1 wherein the plurality of blades each include a rigid blade holder and a compliant blade member extending from the blade holder having a blade tip adapted to engage the associated image forming machine moving surface when the respective blade is moved into the working position.

8. The blade engagement system of claim 1 wherein the system is a metering and/or cleaning system.

9. A blade engagement apparatus adapted to removably receive an associated blade cassette having a plurality of blades for use with an associated image forming machine moving surface, the blade engagement apparatus comprising:

a housing having a blade cassette chamber for removably receiving an associated blade cassette having a plurality of blades; and a blade positioning mechanism ejecting each of the associated blades one at a time from the blade cassette and moving each of the associated blades one at a time into a working position in engagement with the associated image forming machine moving surface.

10. A blade engagement apparatus of claim 9 wherein the blade positioning mechanism further comprises an arm assembly for holding one of the associated blades and an actuator connected to the arm assembly for moving the one of the associated blades into the working position.

11. The blade engagement apparatus of claim 10 wherein the arm assembly includes a first arm having a jaw and a second arm having a jaw disposed in a facing relationship with the first arm jaw for holding a blade between the jaws, the first arm being moveable with respect to the second arm for opening and closing the jaws.

12. The blade engagement apparatus of claim 11 wherein the actuator is connected to the first arm for moving the first arm, and the second arm is connected to the first arm for movement therewith, the blade engagement apparatus further comprising a stop for abutting the second arm preventing movement of the second arm as the first arm is moved by the actuator for opening and closing the jaws.

13. The blade engagement apparatus of claim 12 wherein the blade positioning mechanism includes a pair of arm assemblies each disposed in the blade engagement apparatus at an opposite side of the blade cassette chamber for holding the lateral ends of the blade for movement into the working position.

14. The blade engagement apparatus of claim 9 wherein the apparatus is a metering and/or cleaning apparatus.

15. A blade cassette adapted to be received in an associated blade engagement apparatus for use in an associated image forming machine having a moving surface, the blade cassette comprising:

a cassette housing having an aperture and an unused blade storage section; and a plurality of blades disposed in the cassette housing, each blade having a compliant blade member having a blade tip; and a blade conveyor moving the blades within the cassette from the unused blade storage section to the aperture for movement from the cassette into a working position with the blade tip engaging the moving surface.

16. The blade cassette of claim 15 wherein the cassette housing further comprises a used blade storage section for storing blades returned to the cassette housing after use.

17. The blade cassette of claim 16 wherein the blade conveyor moves the blades from the aperture into the used blade storage section.

18. The blade cassette of claim 15 wherein the blade conveyor is spring biased.

19. The blade cassette of claim 15 wherein the blade conveyor is connected to a powered actuator for moving the blades.

* * * * *